United States Patent [19]

Brois et al.

[11] 4,142,866

[45] Mar. 6, 1979

[54] AMINE SALTS OF THIO-BIS-LACTONE ACIDS IN COMBINATION WITH COADDITIVE HYDROCARBONS ARE FLOW IMPROVERS FOR MIDDLE DISTILLATE FUEL OILS

[75] Inventors: Stanley J. Brois, Westfield; Antonio Gutierrez, Mercerville; Nicholas Feldman, Woodbridge, all of N.J.

[73] Assignee: Exxon Research & Engineering Co., Florham Park, N.J.

[21] Appl. No.: 875,239

[22] Filed: Feb. 6, 1978

[51] Int. Cl.[2] ..... C10L 1/24

[52] U.S. Cl. ..... 44/63; 44/80; 260/343.6

[58] Field of Search ..... 44/63, 80; 260/343.6

[56] References Cited

U.S. PATENT DOCUMENTS

| | | | |
|---|---|---|---|
| 3,600,311 | 8/1971 | Naiman et al. | 44/62 |
| 3,660,058 | 5/1972 | Feldman et al. | 208/15 |
| 4,062,786 | 12/1977 | Brois et al. | 252/51.5 R |

*Primary Examiner*—Winston A. Douglas
*Assistant Examiner*—Y. Harris-Smith
*Attorney, Agent, or Firm*—Roland A. Dexter

[57] ABSTRACT

Secondary amine salts of oil-soluble thio-bis-($C_{12-50}$ alkyl lactone acid), e.g. a di-tallow secondary amine bis salt of thio-bis ($C_{22}$ lactone carboxylic acid), are useful in combination with a coadditive hydrocarbon such as an amorphous hydrocarbon or a hydrogenated polybutadiene in improving the cold flow properties of distillate hydrocarbon oils.

7 Claims, No Drawings

AMINE SALTS OF THIO-BIS-LACTONE ACIDS IN COMBINATION WITH COADDITIVE HYDROCARBONS ARE FLOW IMPROVERS FOR MIDDLE DISTILLATE FUEL OILS

BACKGROUND OF THE INVENTION

1. Field of the Invention

The invention relates to an amine salt of a sulfur compound in combination with a coadditive hydrocarbon as middle distillate fuel flow improvers.

2. Description of the Prior Art

Heating oils and other middle distillate petroleum fuels, e.g., diesel fuels, contain normal paraffin hydrocarbon waxes which, at low temperatures, tend to precipitate in large crystals in such a way as to set up a gel structure which causes the fuel to lose its fluidity thereby presenting difficulties in transporting the fuel through flow lines and pumps. The wax crystals that have come out of solution also tend to plug fuel lines, screens and filters. This problem has been well recognized in the past and various additives known as pour point depressants have been used to change the nature of the crystals that precipitate from the fuel oil, thereby reducing the tendency of the wax crystals to set into a gel.

It is known in the prior art to employ various polymeric and copolymeric materials as pour point depressants for controlling wax deposition of wax-containing petroleum fractions, e.g. U.S. Pat. No. 3,600,311 teaches that branched alkylene polymers having a molecular weight of about 1,000 to 50,000 and with 10–55% branching, e.g. hydrogenated polybutadiene, can be used to improve the cold flow characteristics of middle distillate fuels.

Recently, it has become known that pour point depression alone is not a sufficient phenomenon to alleviate some problems caused by wax crystals in various fuels, especially middle distillates. In those petroleum fractions, it has been observed that the wax crystals formed in the presence of the pour point depressant are often too large to enable the wax-cloudy fuels to pass easily through screens and orifices commonly encountered in the equipment employed either in distribution or in use of such fuels. This problem has been alleviated by the addition to said fraction of petroleum products of wax crystal modifiers which are referred to as flow and filterability improvers.

U.S. Pat. No. 3,961,916 teaches that the low temperature flow characteristics of petroleum middle distillates can be very satisfactorily controlled by the proper choice of a combination of a nucleating agent or wax growth stimulator and a wax crystal growth arrester.

Other additive combinations have been taught for modifying the cold flow characteristics of petroleum fuels including:

U.S. Pat. No. 3,846,093 teaches modifying the low temperature filterability of middle distillate fuels by the addition of an amorphous hydrocarbon and an N-aliphatic hydrocarbyl succinamic acid or derivative thereof; and, U.S. Pat. No. 4,014,663 teaches a synergistic mixture based on the combination of a hydrocarbon which is a derivative of an alphaolefin and said succinamic acid or derivative thereof.

SUMMARY OF THE INVENTION

It has been found that amine salts of thio-bis-($C_{12}$ to $C_{50}$ alkyl lactone carboxylic acid) in combination with a coadditive hydrocarbon of the class consisting of an amorphous hydrocarbon, a hydrogenated butadiene and mixtures thereof further improves the cold flow characteristics of a middle distillate petroleum fuel oil boiling within the range of about 120° C. to about 400° C. at atmospheric pressure.

In accordance with the present invention, a fuel composition is provided which comprises a major proportion, i.e. more than 50% by weight, of a distillate petroleum fraction preferably having an atmospheric boiling range of from about 120° C. to about 400° C. and from about 0.001 to 1.0 wt. % of a flow and filterability improving combination comprising: (a) 1 to 5 parts by weight of an amine salt of a thio-bis-($C_{12}$ to $C_{50}$, preferably $C_{18}$ to $C_{28}$, alkyl lactone acid), preferably secondary amine salts of the general formula

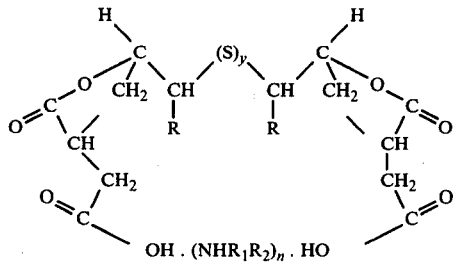

wherein R represents an alkyl group of from 8 to 40, preferably 12 to 24 carbons, y represents the number 1 or 2, n represents the number of 1 to 2 and $R_1$ and $R_2$ are selected from the class of an aliphatic hydrocarbon of 8 to 30 carbon atoms and an oxyaliphatic hydrocarbon of from 8 to 30 carbon atoms; and, (b) 1 to 100 parts by weight of a coadditive hydrocarbon of the class consisting of an oil-soluble amorphous hydrocarbon, such as a saturate hydrocarbon fraction, having less than about 5, preferably less than about 1, wt.% of normal paraffin hydrocarbons, which can be illustrated by Coray 200 petrolatum, a hydrogenated polybutadiene having from about 5 to 55, preferably 10 to 30 weight percent 1–2 addition, i.e. branched units and a number average molecular weight ($\overline{M}_n$) ranging from 400 to 10,000, preferably 600 to 3000 and mixtures thereof. It is preferred that the weight ratio of a/b is in the range of 4:1 to 1:25, optimally 2:1 to 1:8. All molecular weights herein are measured by Vapor Phase Osmometry (VPO).

Concentrates of 1 to 60 wt.% of said amine salt additive-hydrocarbon combination in 40 to 99 wt.% of mineral oil, e.g. kerosene, can be prepared for ease of handling.

DETAILED DESCRIPTION OF THE INVENTION

The amine salt flow improver for distillate oils according to this invention is obtained by the reaction of a secondary amine containing 16 to about 60, preferably from about 24 to 48, optimally about 32 carbons, with a thio-bis-($C_{12}$ to $C_{50}$ alkyl lactone carboxylic acid) preferably of the general formula

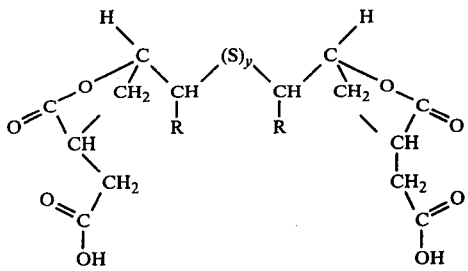

wherein R represents an alkyl group of 5 to 43, preferably 12 to 24 carbons and y is 1 or 2.

Illustrative thio-bis-(alkyl lactone acid) coadditive compounds include thio-bis(alkyl substituted lactone carboxylic acid) wherein the alkyl substituent can be pentyl, octyl, dodecyl, tridecyl, n-tetradecyl, pentadecyl, hexadecyl, heptadecyl, nonadecyl, eicosyl, docosyl and branched analogues and mixtures thereof.

Various secondary amines may be used, both those having the same aliphatic hydrocarbon groups and those having different aliphatic hydrocarbon groups. Either alkyl or alkenyl substituents may be present on the nitrogen, each having at least 8, preferably at least 14, carbon atoms. The range of difference between the two aliphatic hydrocarbon groups bonded at the nitrogen is not critical but will generally be fewer than 8 carbon atoms, more usually fewer than 6 carbon atoms. For most part, the aliphatic hydrocarbon groups will be straight chain, i.e. normal with the amino nitrogen bonded either to internal or terminal carbon atoms.

Examples of secondary amines include di-n-octyl amine, octyl lauryl amine, dodecyl hexadecyl amine, dioctadecyl amine, di-docosyl amine, octadecyl docosyl amine, N-3-hydroxypropylpiperazinylpropyl dodecyl amine, etc.

Amine mixtures may also be used and many amines derived from natural materials are mixtures. Thus, coco amine derived from coconut oil is a mixture of secondary amines with straight chain alkyl groups ranging from $C_8$ to $C_{18}$. Another example is di-tallow secondary amine, derived from hydrogenated tallow, which secondary amine is a mixture of $C_{14}$ to $C_{18}$ straight chain alkyl groups.

The amine salts are readily prepared by mixing together from about 1 to 2 moles of secondary amine to a molar amount of the thio-bis-(alkyl lactone acid) conveniently as prepared, or in an inert solvent. Mild heating from ambient temperature to about 100° C. may facilitate the salt formation.

Particularly effective is the above-described bis amine salt composition wherein the amine employed is hydrogenated di(tallow) amine.

The thio-bis-(alkyl lactone acid) which is used as the precursor for the amine salt may be an individual compound or mixtures of compounds. That is, various alkyl groups of varying branchiness, differing number of carbon atoms or different positions of attachment relative to the lactone acid group may be used. Alternatively, a single isomer may be used. Since mixtures are generally more readily available, to that degree they are preferred. Frequently, mixtures will be used of thio-bis-(alkyl lactone acid) wherein no single homolog is present in amount greater than 25 mole percent.

The thio-bis-(alkyl lactone acid) is readily prepared according to the teachings of U.S. patent application Ser. No. 726,206 filed Sept. 24, 1976, now U.S. Pat. No. 4,062,786 of common assignee, which is incorporated herein by reference thereto. The thio-bis-(lactone acid) can be conveniently prepared by sulfur halide addition to the double bond in alkenyl succinic anhydride at about −60° C. to 100° C. followed by lactonization via an internal displacement of the halide with water. Alternatively, alkenyl succinic acid can be reacted with sulfur halide at from about −60° C. to 100° C. resulting in adduct formation which undergoes lactonization at temperatures above about 25° C. since the temperature governs the displacement of the halide e.g. chloride by a vicinal carboxylic acid group.

The preparation of alkenyl succinic anhydrides and acids is well known by either the "ene" reaction wherein an olefin is reacted with maleic anhydride or fumaric acid or a Diels-Alder reaction of a halogen substituted aliphatic material, e.g. chloro-polyisobutylene, with maleic anhydride or fumaric acid (see U.S. Pat. No. 2,568,876).

If desired, solvents comprising hydrocarbons such as pentane, hexane, heptane, cyclohexane, mineral oil; halocarbons such as methylene chloride, chloroform, carbon tetrachloride, aromatics such as toluene, chlorobenzenes, xylene; ethers such as diethyl ether and tetrahydrofuran (THF); and, acids such as acetic, propionic and trifluoroacetic acid, can be used in favorably controlling viscosity and reaction temperature. The mode of addition of reagents is dictated by convenience. Usually, the sulfur halide, preferably $SCl_2$ or $S_2Cl_2$ is added dropwise to the alkenyl acid or acid anhydride, preferably diluted in an inert diluent.

The anhydride reactants can be the same or different so that mixtures of symmetrical and unsymmetrical thio-bis, i.e. bridged, anhydride or acid products can be constructed at will. Higher conversions to unsymmetrical adducts can be achieved by the interaction of equimolar amounts of sulfur halide and one type of alkenedioic acid or anhydride at low temperatures i.e. −60° C. to about 20° C., to generate a discrete 1:1 sulfur halide-alkenyl succinic anhydride or acid adduct exclusively. Subsequent addition of a second type of unsaturated anhydride affords the unsymmetrical bridged product predominantly.

Increasing bridging temperature and branching in the alkenyl anhydrides tend to accelerate the elimination of HCl from the intermediate adducts. Since the unsaturated bridged products can be further reacted with a sulfur halide reagent, it becomes necessary in some cases, to modify the theoretical 2:1 stoichiometry of alkenyl succinic anhydride or acid to sulfur halide to effect complete bridging. Accordingly, at higher temperatures, e.g. 100° C., molar ratios of alkenyl succinic anhydride or acid to sulfur halide in the range of 1.5:1 to 1:1 may be required to realize higher conversions to bridged structures. Thus in summary, the thio-bis-(alkyl lactone carboxylic acid) is obtained from the reaction of from about 1 to 2 moles of alkenyl succinic anhydride or acid per mole of sulfur halide, preferably $S_xCl_2$ wherein x is 1 or 2, at a temperature of from −60° C. to 100° C. followed by lactonization which is obtained via the addition of water to the anhydride and may be synchronous with dehydrohalogenation for the acid reactant when the temperature is above about 25° C.

Amorphous Hydrocarbon

The amorphous hydrocarbon useful in this invention as coadditive with the amine salt is an amorphous, normally solid, essentially saturated hydrocarbon fraction having a number average molecular weight within the range from about 600 to about 3,000, said hydrocarbon fraction being substantially free of normal paraffinic hydrocarbons, preferably having no more than about 1 wt.% of normal paraffins, and having been obtained from a residual petroleum oil. The amorphous hydrocarbon is fully described in U.S. Pat. No. 3,660,058 (see particularly column 2, lines 30 ff) which is incorporated herein by reference thereto.

An amorphous hydrocarbon fraction can be obtained by deasphalting a residual petroleum fraction and then adding a solvent such as propane, lowering the temperature of the solvent-diluted residuum, and recovering the desired solid or semi-solid amorphous product by precipitation, followed by filtration. The residual oil fractions from which the desired amorphous hydrocarbons are obtained will have viscosities of at least 125 SUS at 99° C. Most of these residual oils are commonly referred to as bright stocks.

Hydrogenated Polybutadiene

Useful hydrogenated polybutadienes are described in U.S. Pat. No. 3,600,311. Hydrogenated polybutadienes are branched polymers which have about 5 to 55, preferably 10 to 30, 1–2 addition and 45 to 95, preferably 70 to 90, 1–4 addition and usefully have a number average molecular weight ($M_n$) of 400 to 10,000, are readily prepared by polymerizing butadiene in a suitable solvent, e.g. hydrocarbon, in the presence of an organometallic catalyst, e.g. n-butyl lithium. The resulting polymer is then hydrogenated e.g. with hydrogen in the presence of a nickel catalyst until saturated, e.g. 1 wt.% unsaturation.

Middle Distillate Fuels

The distillate fuel oils that can be improved by this invention include those having boiling ranges within the limits of about 120° to about 400° C. The distillate fuel oil can comprise straight run or virgin gas or cracked gas oil or a blend in any proportion of straight run and thermally and/or catalytically cracked distillates.

The most common petroleum middle distillate fuels are kerosene, diesel fuels, jet fuels and heating oils. Since jet fuels are normally refined to very low pour points there will be generally no need to apply the present invention to such fuels. The low temperature flow problem is most usually encountered with diesel fuels and with heating oils. A representative heating oil specification calls for a 10 percent distillation point no higher than about 226° C., a 50 percent point no higher than about 272° C., and a 90 percent point of at least 282° C. and no higher than about 338° C. to 343° C., although some specifications set the 90 percent point as high as 357° C. Heating oils are preferably made of a blend of virgin distillate, e.g., gas oil, naphtha, etc., and cracked distillates, e.g., catalytic cycle stock. A representative specification for a diesel fuel includes a minimum flash point of 38° C. and a 90 percent distillation point between 282° C. and 338° C. (See ASTM Designations D-396 and D-975).

The additive combination of the invention may be used alone or in combination with still other fuel additives; e.g., corrosion inhibitors; antioxidants, sludge inhibitors, etc.

The invention will be further understood by reference to the following examples which include preferred embodiments of the invention.

EXAMPLES

The following materials were used:

Bis Amine Salt of Thio-Bis-(Alkyl Lactone Acid)

This is the bis, hydrogenated, di-tallow amine salt of dithio-bis (alkyl lactone carboxylic acid) prepared via the steps of: (1) forming an adduct of $S_2Cl_2$ and n-$C_{18}$ succinic acid which upon heating underwent dehydrohalogenation and lactonization; and (2) reacting the product with about twice the molar amount of the hydrogenated di-tallow amine which provides a product designated hereafter as the Bis-Amine Salt.

Two hundred grams (0.54 mole) of n-octadecenyl succinic acid were dissolved in a liter of $CHCl_3$ and 36.7 g (0.272 mole) of sulfur monochloride ($S_2Cl_2$) were added dropwise to the stirred solution at room temperature. The exothermic process was accompanied by vigorous HCl evolution. After refluxing the mixture for about eight hours, the solution was cooled and solids separated. Filtration gave 19 g of solid (m.p. 131–136° C.) which featured an IR spectrum with intense carbonyl bands at 5.62 and 5.72 microns, and analyzed for 66.42% C, 9.63% H, and 8.22% S. Theory for the adduct ($C_{44}H_{78}O_8S_2$) requires 66.12% C, 9.84% H, and 8.02% S. Rotoevaporation of the supernatant gave a solid product in high yield. The proposed structure for the dithio-bis-(alkyl lactone acid), namely, 6,6'-dithio-bis-(3,5 carbolactone-1-heneicosanoic acid), is given below and indicated by the structural formula I:

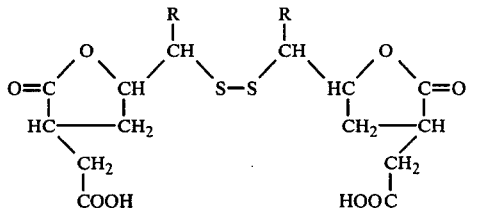

I wherein R represents n-$C_{15}H_{31}$.

The Bis-Amine Salt is prepared as follows:

Seven grams (~0.01 mole) of the dithio-bis-(alkyl lactone acid) of formula I as prepared above was dissolved in 25 ml of tetrahydrofuran (THF) and combined with 10.2 g (ca. 0.02 mole) of hydrogenated di-tallow amine purchased as Armeen 2HT from Armak Corp. of Chicago, IL. The mixture was allowed to reflux at about 60° C. for a few minutes to assure complete reaction.

While the reaction solution was still hot, acetone was added to the cloud point and a white solid precipitated out while cooling to room temperature. The solid was filtered, collected and dried at room temperature. A quantitative yield of the dithio-bis (alkyl lactone acid) salt was obtained. The infrared spectrum shows the characteristic for the lactone acid salt at 5.6 microns for the lactone and 6.3–6.4 microns for the carboxylate group.

Mono Amine Salt of Thio-Bis(Alkyl Lactone Acid)

The thio-bis (alkyl lactone acid) salt containing only one equivalent of said di-tallow amine was prepared in a similar manner as above, except that 0.01 mole of said thio-bis (alkyl lactone acid) of formula I was treated with 0.01 mole of said di-tallow amine.

Hydrogenated Polybutadiene

The hydrogenated polybutadiene had an ($\overline{M}_n$) of about 1250, a Bromine No. of 0.3 and a Fisher-Johnes melting point of 33°–44° C. The hydrogenated polybutadiene was prepared with a n-butyl lithium catalyst and hydrogenated with hydrogen in the presence of a Raney nickel catalyst.

Amorphous Hydrocarbon

An amorphous hydrocarbon fraction (m.p. 43.9 g.) obtained by propane precipitation from the deasphalted residuum of a Texas coastal crude oil was found by mass spectrographic analysis, and by gas chromatography, to contain 5 wt.% of isoparaffins, 22 wt.% of aromatic hydrocarbons, 73% of cycloparaffins, and no more than a trace of normal paraffin hydrocarbons. The number average molecular weight of this material was about 775 as determined by osmometry.

The distillation characteristics of this solid hydrocarbon fraction were as follows:

Table I

| Distillation (ASTM D-1160 | Vapor Temp. at 5 mm Hg | Vapor Temp. Converted to Atmospheric Pressure |
|---|---|---|
| Initial BP | 228° C. | 401° C. |
| 5% | 310° C. | 497° C. |
| 10% | 336° C. | 526° C. |
| 20% | 364° C. | 557° C. |
| 24% | 365° C. | 558° C. |

Only 24% would distill over.
There were 75% bottoms and 1% loss.

Fuel

The properties of the middle distillate fuels tested are summarized in Table II which follows:

Table II

| | Fuel 1 | Fuel 2 |
|---|---|---|
| Cloud Point, ° C. | −1 | +1 |
| Distillation, ° C. (per ASTM D-86) | | |
| IBP | 162 | 170 |
| 20% | 220 | 225 |
| 95% | 346 | 343 |
| FPB | 370 | 371 |
| n-Paraffin Range, Carbon Nos. | 10–29 | 11–29 |

Blending of the additives into the fuel was accomplished by their dissolution into the fuel oil. This was done while warming, e.g. heating the oil and additive to about 90° C. if the additive or mixture of additives per se were added, and stirring.

The blends were then tested for their cold flow properties in the test described below.

The Cold Filter Plugging Point Test (CFPPT)

The cold flow properties of the blend were determined by the Cold Filter Plugging Point Test (CFPPT). This test is carried out by the procedure described in detail in "Journal of the Institute of Petroleum," Volume 52, Number 510, June 1966 pp. 173–185. In brief, a 40 ml. sample of the oil to be tested is cooled by a bath maintained at about −34° C. Periodically, (at each one degree Centigrade drop in temperature starting from 2° C. above the cloud point) the cooled oil is tested for its ability to flow through a fine screen in a time period. This cold property is tested with a device consisting of a pipette to whose lower end is attached an inverted funnel positioned below the surface of the oil to be tested. Stretched across the mouth of the funnel is a 350 mesh screen having an area of about 0.45 square inch. The periodic tests are each initiated by applying a vacuum to the upper end of the pipette whereby oil is drawn through the screen up into the pipette to a mark indicating 20 ml. of oil. The test is repeated with each one degree drop in temperature until the oil fails to fill the pipette within 60 seconds. The results of the test are reported as the temperature in ° C. at which each of the oils fail to fill the pipette in the prescribed time.

The blends prepared and the test results are summarized in Table III which follows:

TABLE III

Effectiveness of Additives in the Fuels

| Example | Wt. % Active Ingredient | Additive | Fuel 1 CFPPT° C. | Fuel 2 CFPPT° C. |
|---|---|---|---|---|
| 1 | — | none | 0° C. | |
| 2 | 0.07 | Amorphous Hydrocarbon | −6 | |
| 3 | 0.07 | Bis-Amine Salt | −2 | |
| 4 | 0.05 | Amorphous Hydrocarbon | −8 | |
| | 0.01 | Bis-Amine Salt | | |
| 5 | 0.05 | Amorphous Hydrocarbon | −11 | |
| | 0.02 | Bis-Amine Salt | | |
| 6 | — | none | | 0 |
| 7 | 0.06 | Hydrogenated Polybutadiene | | −3 |
| 8 | 0.06 | Bis-Amine Salt | | −1 |
| 9 | 0.04 | Hydrogenated Polybutadiene | | −8 |
| | 0.02 | Bis-Amine Salt | | |

The data of Table III clearly demonstrates the synergistic advantage of the co-additive combination of the invention with comparison of: Examples 2 and 3 with a CFPPT° C. of −6 and −2 respectively, and Example 5 where the co-additive combination reduced the CFPPT° C. down to −11; and, the single components of Examples 7 and 8 with a CFPPT° C. of −3 and −1 respectively, and Example 9 where the co-additive combination of the invention reduced the CFPPT° C. down to −8° C.

The invention in its broader aspect is not limited to the specific details shown and described and departures may be made from such details without departing from the principles of the invention and without sacrificing its chief advantages.

What is claimed is:

1. A fuel composition comprising a major proportion of a distillate petroleum fraction having an atmospheric boiling range of from about 120° C. to about 400° C. and from about 0.01 to 1.0 wt.% of a flow and filterability improving combination comprising: (a) 1 to 5 parts by weight of a secondary amine salt of thio-bis-($C_{12}$ to $C_{50}$ alkyl lactone carboxylic acid); and (b) 1 to 100 parts by weight of a coadditive hydrocarbon of the class consisting of an oil-soluble amorphous hydrocarbon having less than about 5 wt.% of normal paraffin hydrocarbons, a hydrogenated polybutadiene having a number average molecular weight ranging from 400 to 10,000 and mixtures thereof.

2. A fuel composition according to claim 1 wherein said thio-bis-($C_{12}$ to $C_{50}$ alkyl lactone carboxylic acid) is of the general formula:

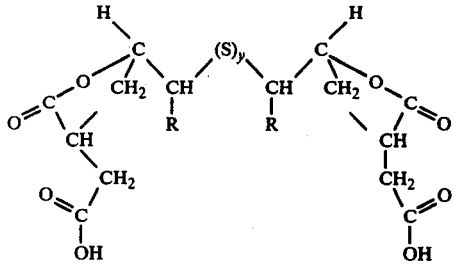

wherein R represents an alkyl group of 8 to 40, and y is 1 or 2.

3. A fuel composition according to claim 1 wherein the weight ratio of said (a) to said (b) ranges from 4:1 to 1:25 and said amine salt is of the general formula

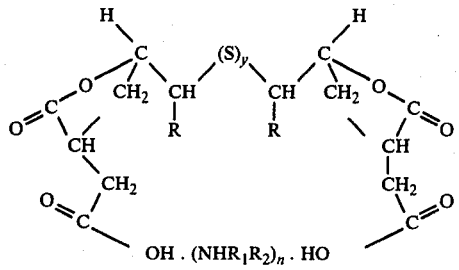

wherein R represents an alkyl group of from 12 to 24 carbons, y represents the number 1 or 2, $R_1$ and $R_2$ are selected from the class of an aliphatic hydrocarbon of 8 to 30 carbon atoms and an oxyaliphatic hydrocarbon of from 8 to 30 carbon atoms and n represents the integer 1 or 2.

4. The composition of claim 1 wherein said alkyl group is a substantially linear chain of 15 carbons, $R_1$ and $R_2$ are each a mixture of $C_{14}$ to $C_{18}$ alkyl groups obtained from hydrogenated tallow and n is 2.

5. The composition of claim 4 wherein said hydrocarbon is hydrogenated polybutadiene having a ($\overline{M}_n$) ranging from 600 to 3,000.

6. An additive concentrate comprising from about 1 to 60 wt.% of an additive combination consisting essentially of from 1 to 5 parts by weight of a secondary amine salt of thio-bis-($C_{12}$ to $C_{50}$ alkyl lactone carboxylic acid) and from 1 to 100 parts by weight of an oil-soluble amorphous hydrocarbon having less than about 5 wt.% of normal paraffin hydrocarbons dissolved in a hydrocarbon solvent.

7. A secondary amine salt of the general formula

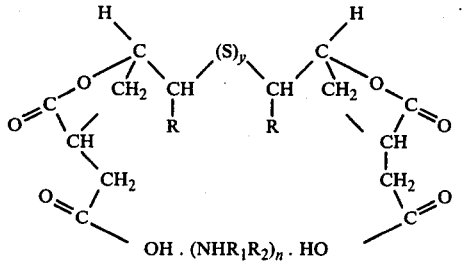

wherein R represents an alkyl group of from 8 to 40 carbons, y represents the number 1 or 2, $R_1$ and $R_2$ are selected from the class of an aliphatic hydrocarbon of 8 to 30 carbon atoms and an oxyaliphatic hydrocarbon of from 8 to 30 carbon atoms and n represents the integer 1 or 2.

* * * * *